US010837255B2

(12) United States Patent
Bårdsen et al.

(10) Patent No.: US 10,837,255 B2
(45) Date of Patent: Nov. 17, 2020

(54) DOWNHOLE STRADDLE SYSTEM

(71) Applicant: Welltec Oilfield Solutions AG, Zug (CH)

(72) Inventors: Johnny Bårdsen, Zug (CH); Frode Strømsvik, Zug (CH)

(73) Assignee: Welltec Oilfield Solutions AG, Zug (CH)

( * ) Notice: Subject to any disclaimer, the term of this patent is extended or adjusted under 35 U.S.C. 154(b) by 47 days.

(21) Appl. No.: 16/380,048

(22) Filed: Apr. 10, 2019

(65) Prior Publication Data

US 2019/0316437 A1 Oct. 17, 2019

(30) Foreign Application Priority Data

Apr. 11, 2018 (EP) ..... 18166738
Apr. 23, 2018 (EP) ..... 18168710

(51) Int. Cl.
*E21B 33/126* (2006.01)
*E21B 23/06* (2006.01)
(Continued)

(52) U.S. Cl.
CPC ..... *E21B 33/126* (2013.01); *E21B 23/06* (2013.01); *E21B 33/1243* (2013.01); *E21B 43/122* (2013.01); *E21B 2200/06* (2020.05)

(58) Field of Classification Search
CPC .. E21B 33/127; E21B 33/124; E21B 33/1243; E21B 33/1246
See application file for complete search history.

(56) References Cited

U.S. PATENT DOCUMENTS 2,675,876 A * 4/1954 Conrad ..... E21B 33/1291 166/140
3,412,805 A * 11/1968 Gribbin ..... E21B 33/1243 166/184
3,552,486 A * 1/1971 Burns ..... E21B 33/124 166/147
4,030,545 A * 6/1977 Nebolsine ..... E21B 33/1243 166/191
(Continued)

FOREIGN PATENT DOCUMENTS

EP 2 565 365 3/2013
EP 3 255 240 12/2017
WO 2016/139264 9/2016

OTHER PUBLICATIONS

Extended Search Report for EP18166738.7 dated Oct. 4, 2018, 7 pages.

*Primary Examiner* — Kipp C Wallace
(74) *Attorney, Agent, or Firm* — Nixon & Vanderhye P.C.

(57) ABSTRACT

The present invention relates to a downhole straddle system for sealing off a damaged zone in a well tubular metal structure in a well having a top, comprising: a straddle assembly having a first end, a second end closest to the top, an inner face, a first hydraulic expandable annular barrier and a second hydraulic expandable annular barrier, a downhole tool assembly having a hydraulic operated deployment tool for releasable connecting the downhole tool assembly to the second end of the straddle assembly, the downhole tool assembly further comprising a first sealing unit arranged above the first hydraulic expandable annular barrier and the second hydraulic expandable annular barrier and configured to seal against the inner face of the straddle assembly, and a closing unit configured to close the first end of the straddle assembly, wherein the downhole tool assembly further comprising a sealing device arranged above the deployment tool and the first sealing unit, the sealing device has an annular
(Continued)

Figure 1:
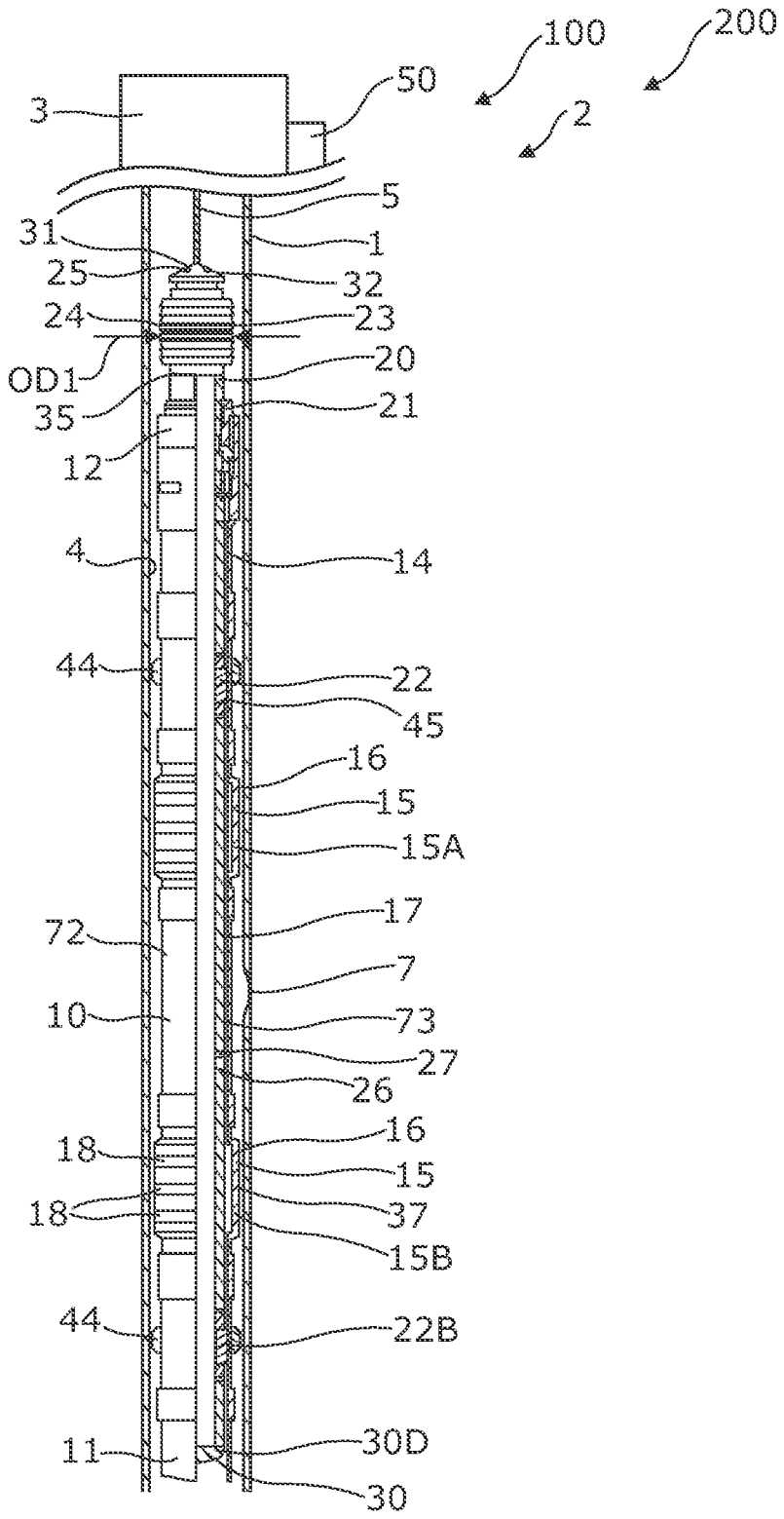

sealing element having a first outer diameter in a first condition and a second outer diameter being larger than the first outer diameter in a second condition for sealing against an inner face of the well tubular metal structure, the sealing device comprises a fluid channel configured to fluidly connect an inside of the straddle assembly with the well tubular metal structure above the sealing device when being in the second condition for expanding the first hydraulic expandable annular barrier and the second hydraulic expandable annular barrier. Finally, the invention relates to a downhole well system and a repairing method.

15 Claims, 12 Drawing Sheets

(51) Int. Cl.
*E21B 33/124* (2006.01)
*E21B 43/12* (2006.01)

(56) References Cited

U.S. PATENT DOCUMENTS 5,343,956 A * 9/1994 Coronado ..... E21B 23/06 166/123
6,065,544 A * 5/2000 Holbert ..... E21B 33/127 166/387
10,648,310 B2 * 5/2020 Frosell ..... E21B 37/00
2004/0251022 A1 * 12/2004 Smith ..... E21B 19/22 166/250.17
2012/0090847 A1 4/2012 Getzlaf et al.
2012/0211232 A1 * 8/2012 Grodem ..... E21B 33/1294 166/341
2014/0158371 A1 * 6/2014 Hallundbæk ..... E21B 23/00 166/377
2015/0252659 A1 * 9/2015 Saltel ..... E21B 33/1243 166/185
2018/0030797 A1 * 2/2018 Sommer ..... E21B 23/04

* cited by examiner

DOWNHOLE STRADDLE SYSTEM

This application claims priority to EP Patent Application No. 18166738.7 filed on Apr. 11, 2018 and EP Patent Application No. 18168710.4 filed on Apr. 23, 2018, the entire contents of each of which are hereby incorporated by reference.

The present invention relates to a downhole straddle system for sealing off a damaged zone in a well tubular metal structure in a well having a top, comprising a straddle assembly having a first end, a second end closest to the top, an inner face, a first hydraulic expandable annular barrier and a second hydraulic expandable annular barrier, and a downhole tool assembly having a hydraulic operated deployment tool for releasable connecting the downhole tool assembly to the second end of the straddle assembly, the downhole tool assembly further comprising a first sealing unit arranged above the first hydraulic expandable annular barrier and the second hydraulic expandable annular barrier and configured to seal against the inner face of the straddle assembly. Finally, the invention relates to a downhole well system and a repairing method.

When a well starts producing too much water, a straddle is set for sealing off the water producing zone. The water production may come from a water breakthrough in the production zone, i.e. the water enters through perforations or productions valves. The water production may also come from an otherwise damaged zone i.e. a leak or deterioration in the wall of the production casing/liner. Leaks or deteriorations may also occur in the production casing above the main packer, and many straddles are therefore set inside the production casing above the main packer in order to maintain well integrity. Known straddles are set by means of drill pipe or coiled tubing where the straddle is connected to the end of the tubing or pipe and the pressure for setting the straddle is applied through the coiled tubing or drill pipe extending from surface.

It is an object of the present invention to wholly or partly overcome the above disadvantages and drawbacks of the prior art. More specifically, it is an object to provide an improved downhole straddle system for sealing off a damaged zone in a well tubular metal structure in a well at a lower cost and/or during a shorter time period.

The above objects, together with numerous other objects, advantages and features, which will become evident from the below description, are accomplished by a solution in accordance with the present invention by a downhole straddle system for sealing off a damaged zone in a well tubular metal structure in a well having a top, comprising:

- a straddle assembly having a first end, a second end closest to the top, an inner face, a first hydraulic expandable annular barrier and a second hydraulic expandable annular barrier,
- a downhole tool assembly having a hydraulic operated deployment tool for releasable connecting the downhole tool assembly to the second end of the straddle assembly, the downhole tool assembly further comprising a first sealing unit arranged above the first hydraulic expandable annular barrier and the second hydraulic expandable annular barrier, and configured to seal against the inner face of the straddle assembly, and
- a closing unit configured to close the first end of the straddle assembly, wherein the downhole tool assembly further comprising a sealing device arranged above the deployment tool and the first sealing unit, the sealing device has an annular sealing element having a first outer diameter in a first condition and a second outer diameter being larger than the first outer diameter in a second condition for sealing against an inner face of the well tubular metal structure, the sealing device comprises a fluid channel configured to fluidly connect an inside of the straddle assembly with the well tubular metal structure above the sealing device when being in the second condition for expanding the first hydraulic expandable annular barrier and the second hydraulic expandable annular barrier.

In one embodiment, the sealing device may comprise a fluid channel extending from an outer face of the sealing device to an inside of the straddle assembly.

In another embodiment, the sealing device may have a first end closest to the top and a second end closest to the straddle assembly, the fluid channel may extend from the first end to the inside of the straddle assembly.

Furthermore, the sealing device may seal against the inner face of the well tubular metal structure above the straddle assembly towards the top in the second condition.

In another embodiment, the sealing device may be electrically operated through a wireline such as an electric line.

In addition, the sealing device may be electrically operated and powered by a battery connected to the sealing device.

Also, the sealing device may be set electrically through a wireline.

Further, the deployment tool may be configured to be released above a certain pressure or by a fluid flow.

By fluid flow is meant a certain flow through the hydraulic operated deployment tool that activates the release of the deployment tool engagement with the straddle assembly.

The deployment tool may comprise a tubular base part and a surrounding tubular piston, the tubular base part and the tubular piston define an expandable space and the tubular base part has an opening providing fluid communication between an inside of the tubular base part and the expandable space.

Moreover, the tubular piston may be connected with retractable engagement elements, the tubular base part comprises at least one indentation for receiving the retractable engagement elements.

Further, the inner face of the straddle assembly may at the second end comprise a groove for engagement with the engagement elements.

Said engagement elements may have a projection for engagement with the groove of the straddle assembly.

Also, the deployment tool may comprise a shear unit connecting the tubular base part and the tubular piston so that when shearing the shear unit, the tubular piston is allowed to move in relation to the tubular base part.

Furthermore, the deployment tool may comprise a spring circumferenting the tubular base part.

Additionally, the closing unit may be a plug, a shear ball seat or a rupture disc arranged in the first end of the straddle assembly.

Also, the plug may be a glass plug.

The shear ball seat may be a movable ball seat which is movable from a first position to a second position when a shear pin is sheared, opening for fluid communication between the inside of the tool and the well tubular metal structure through a tool opening.

Moreover, the downhole tool assembly may comprise the closing unit, the downhole tool assembly may further comprise a tubular section extending below the first sealing unit, the closing unit may comprise a closed end of the tubular section and a second sealing unit arranged below the first hydraulic expandable annular barrier and the second hydraulic expandable annular barrier.

Furthermore, the tubular section may have at least one opening between the first hydraulic expandable annular barrier and the second hydraulic expandable annular barrier.

Additionally, the straddle assembly may comprise at least one centraliser.

Further, the inner face of the straddle assembly may comprise a polished section for abutment against the sealing unit for enhancing the seal therebetween.

The sealing device may comprise an electric motor for operating the sealing element between the first outer diameter and the second outer diameter.

In addition, the electric motor may be powered by a battery.

Also, the deployment tool may comprise engagement elements for engaging the inner face of the straddle assembly at the second end.

The first hydraulic expandable annular barrier and the second hydraulic expandable annular barrier may each comprise an expandable metal sleeve.

Said expandable metal sleeves may each have an outer sleeve face configured to abut the inner face of the well tubular metals structure, the outer sleeve faces comprise a seal.

Moreover, the deployment tool may comprise a fail-safe arrangement configured to maintain the engagement elements in engagement with the straddle assembly in a first position and at a predetermined pressure move to a second position in which the engagement elements are allowed to retract from engagement with the straddle assembly.

Further, the fail-safe arrangement may comprise a breakable element.

The fail-safe arrangement may comprise a tubular piston movable from the first position to the second position of the deployment tool when influenced by a pressure above a certain pressure.

The downhole well system may further comprise:

- a well tubular metal structure having a top and a damaged zone,
- a downhole straddle system, as described above, configured to be arranged opposite the damaged zone for arranging a straddle assembly over the damaged zone, and
- a pump arranged at the top of the well tubular metal structure configured to pressurise the well tubular metal structure.

Also, a repairing method according to the present invention may comprise:

- detecting a damaged zone of a well tubular metal structure,
- arranging a downhole straddle system opposite the damaged zone,
- activating the annular sealing element of the sealing device,
- pressurizing the well tubular metal structure above the sealing device,
- expanding the first hydraulic expandable annular barrier and the second hydraulic expandable annular barrier via the fluid channel of the sealing device for isolating the damaged zone,
- deactivating the annular sealing element of the sealing device,
- releasing the deployment tool from the straddle assembly, and
- removing the downhole tool assembly from the well tubular metal structure.

Additionally, the sealing device may be electrically operated through a wireline, such as an electric line.

Further, in the repairing method according to the present invention the well tubular metal structure may be pressurised above a certain or predetermined pressure whereby the deployment tool is released from the straddle assembly.

Figure 2:
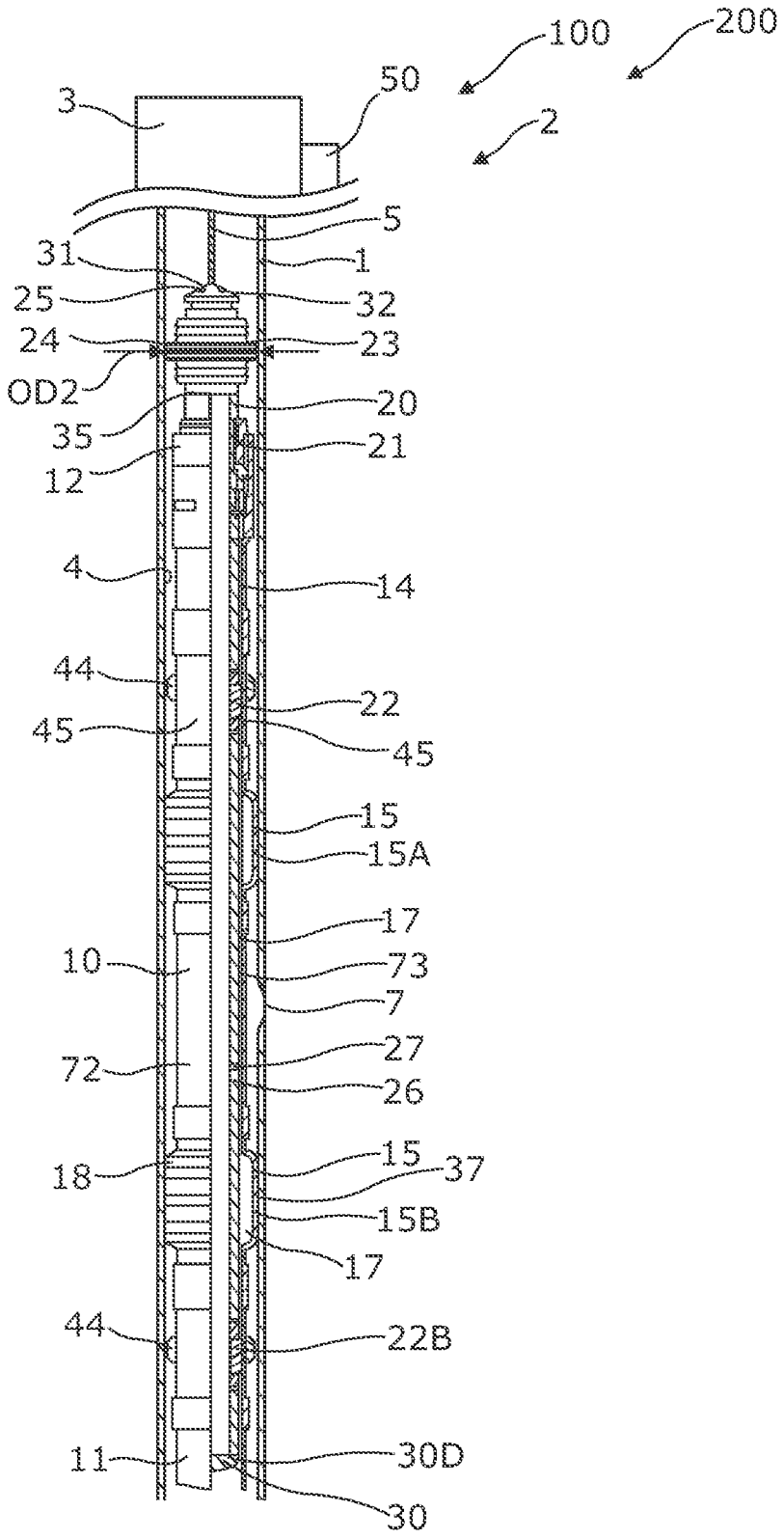
Figure 3B:
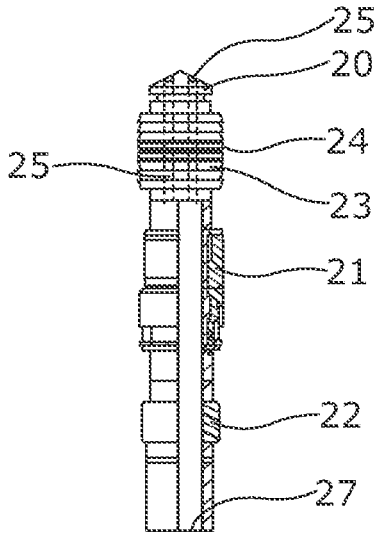
Figure 3A:
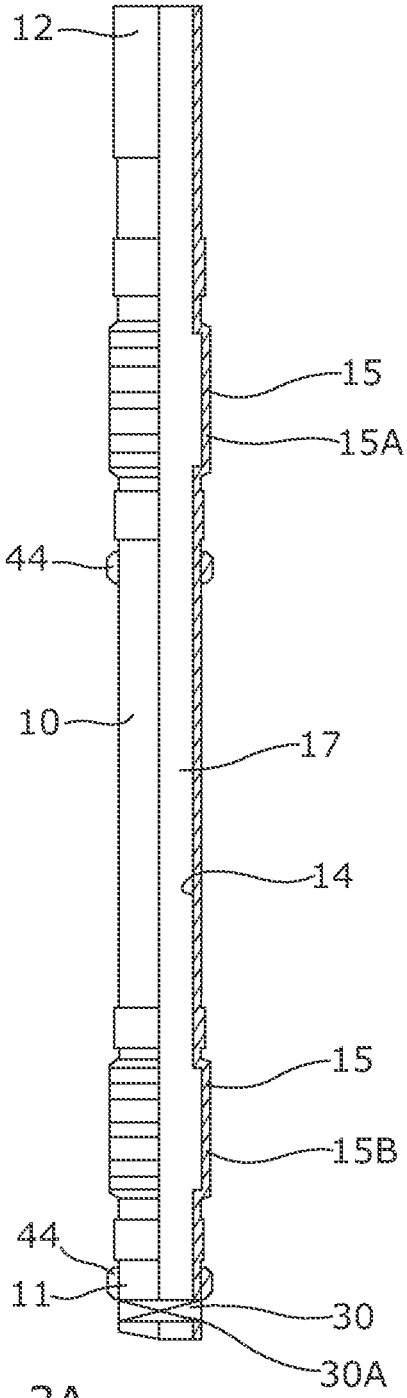
Figure 4B:
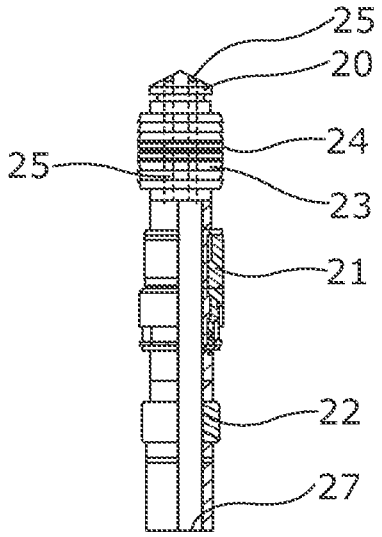
Figure 4A:
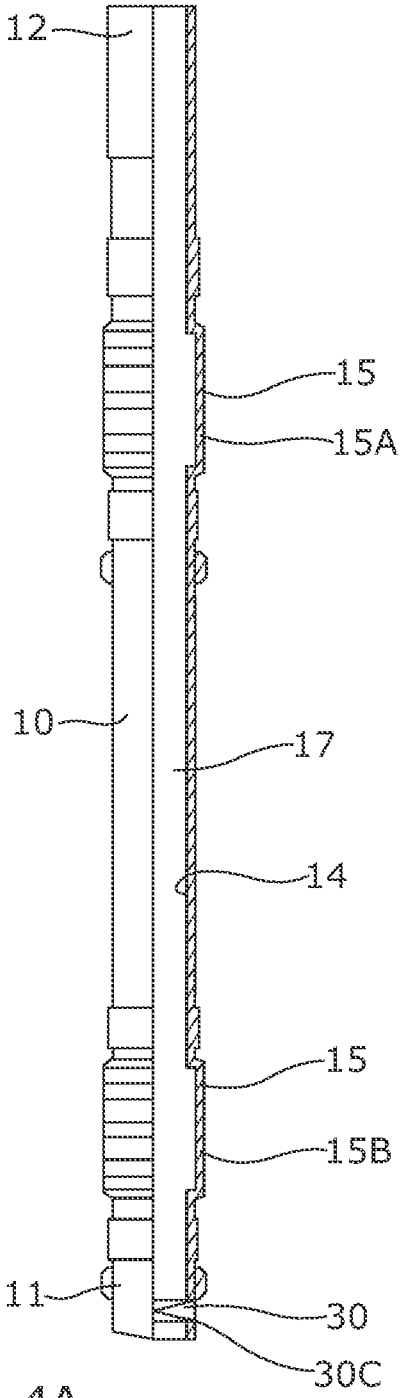
Figure 5A:
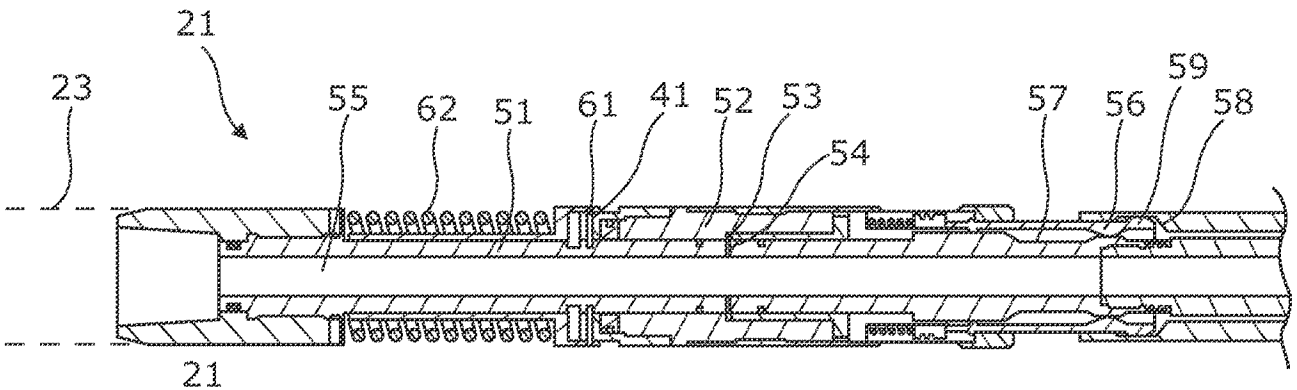
Figure 5B:
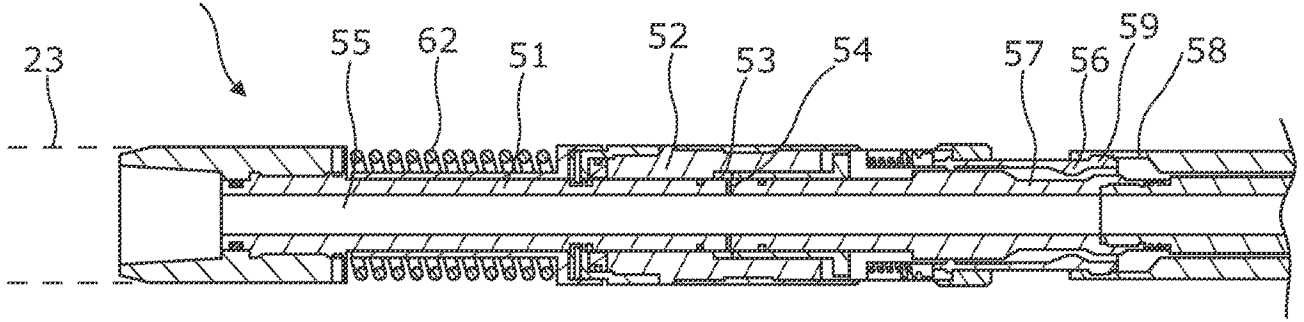
Figure 5C:
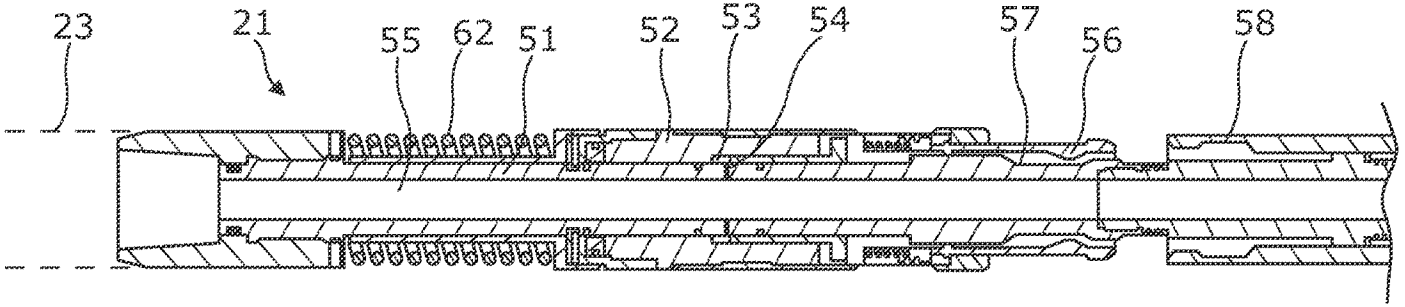
Figure 6:
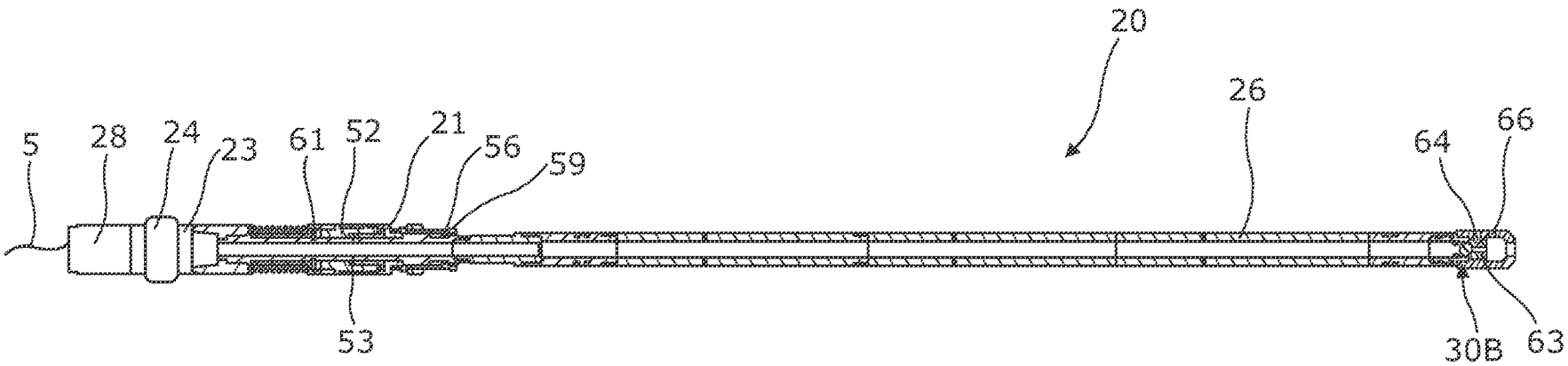
Figure 7A:
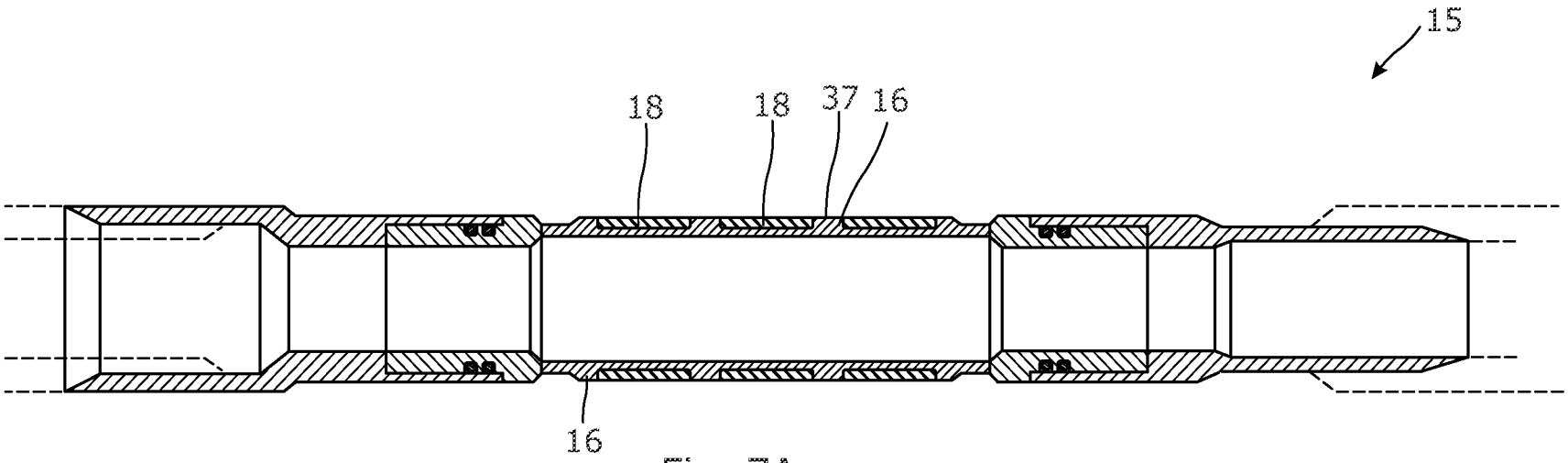
Figure 7B:
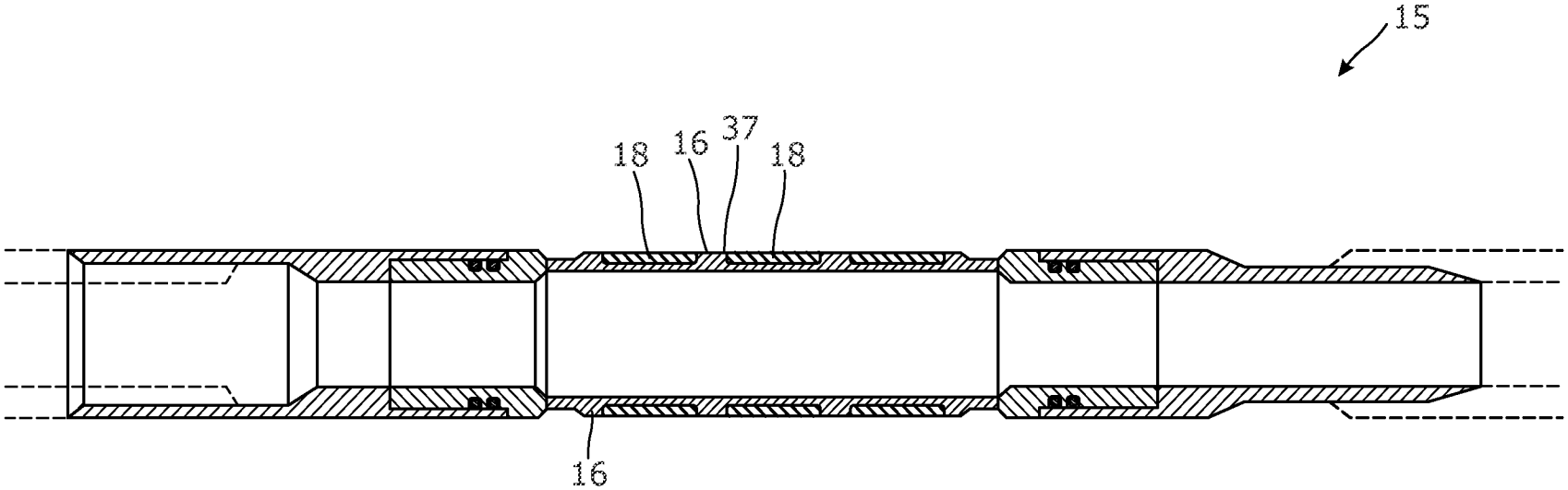
Figure 8:
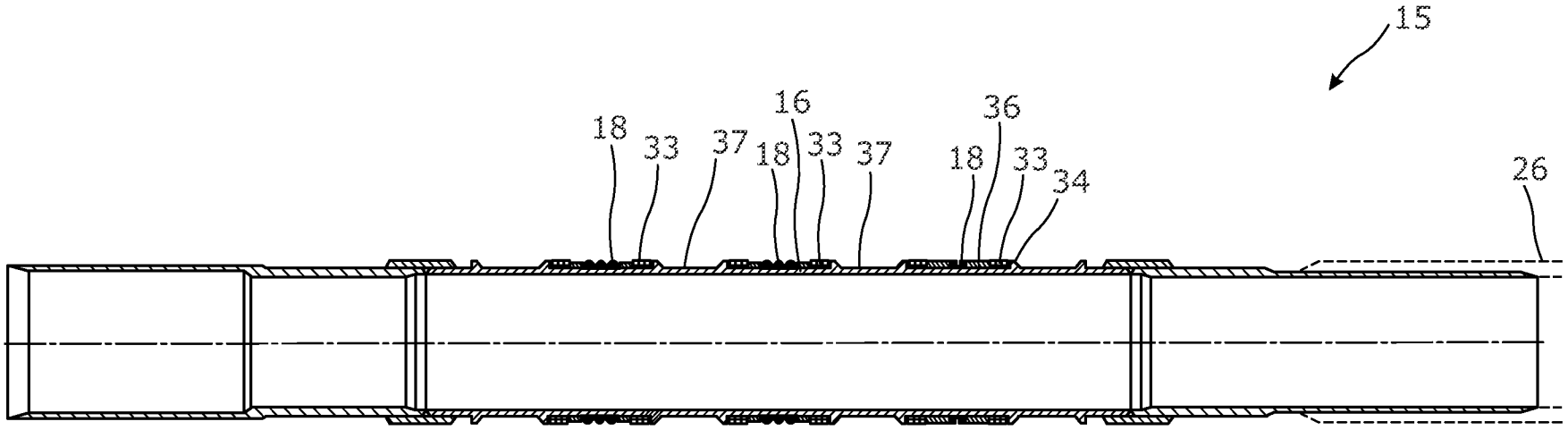
Figure 9:
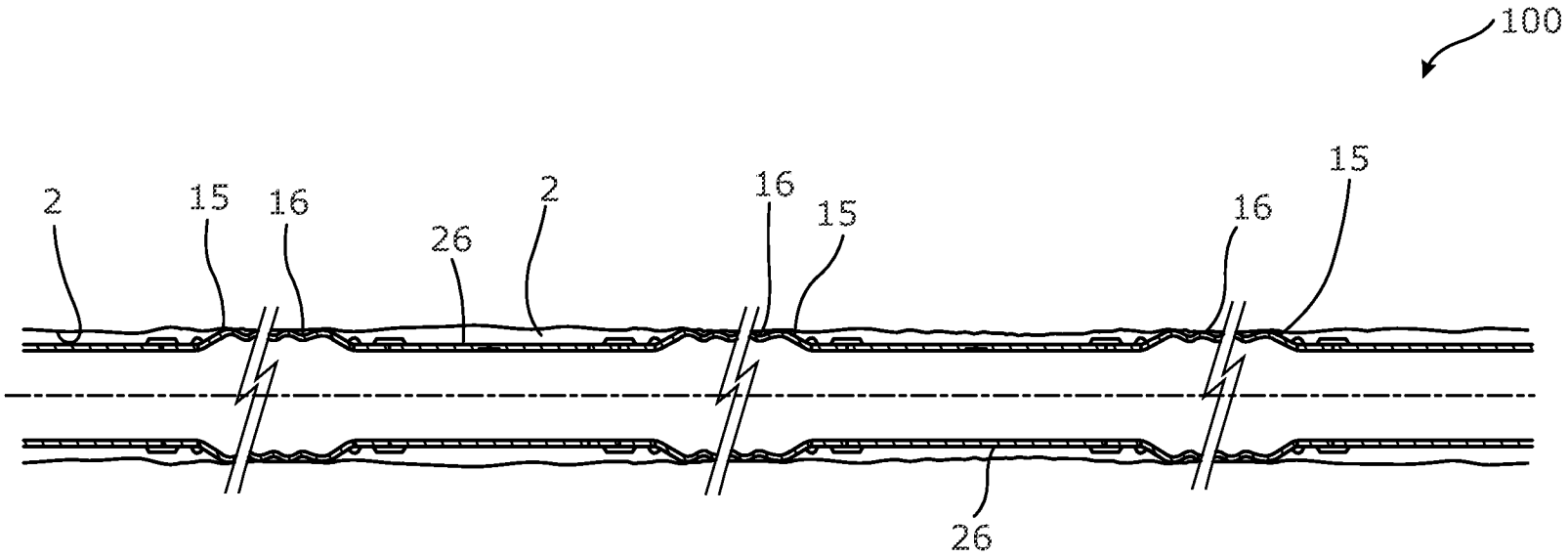
Figure 10:
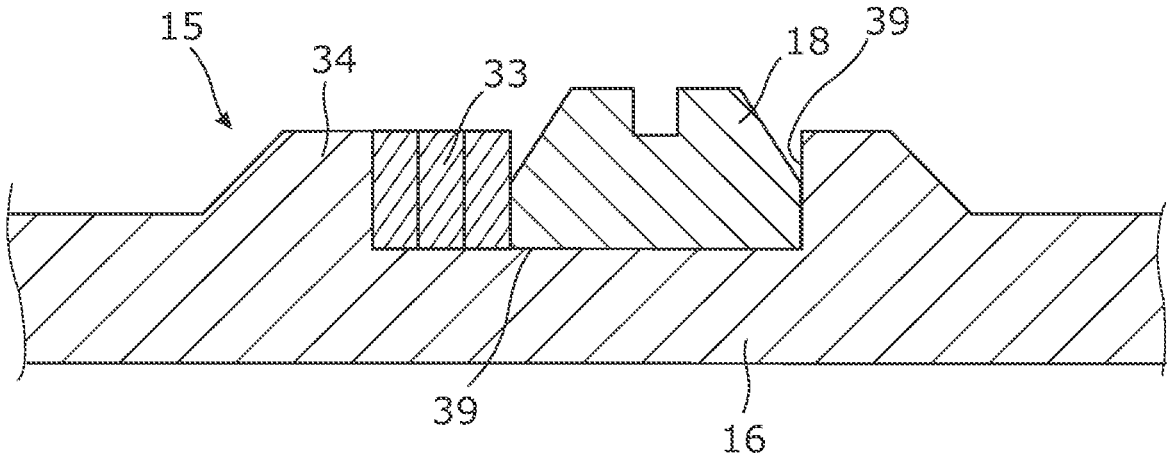
Figure 11:
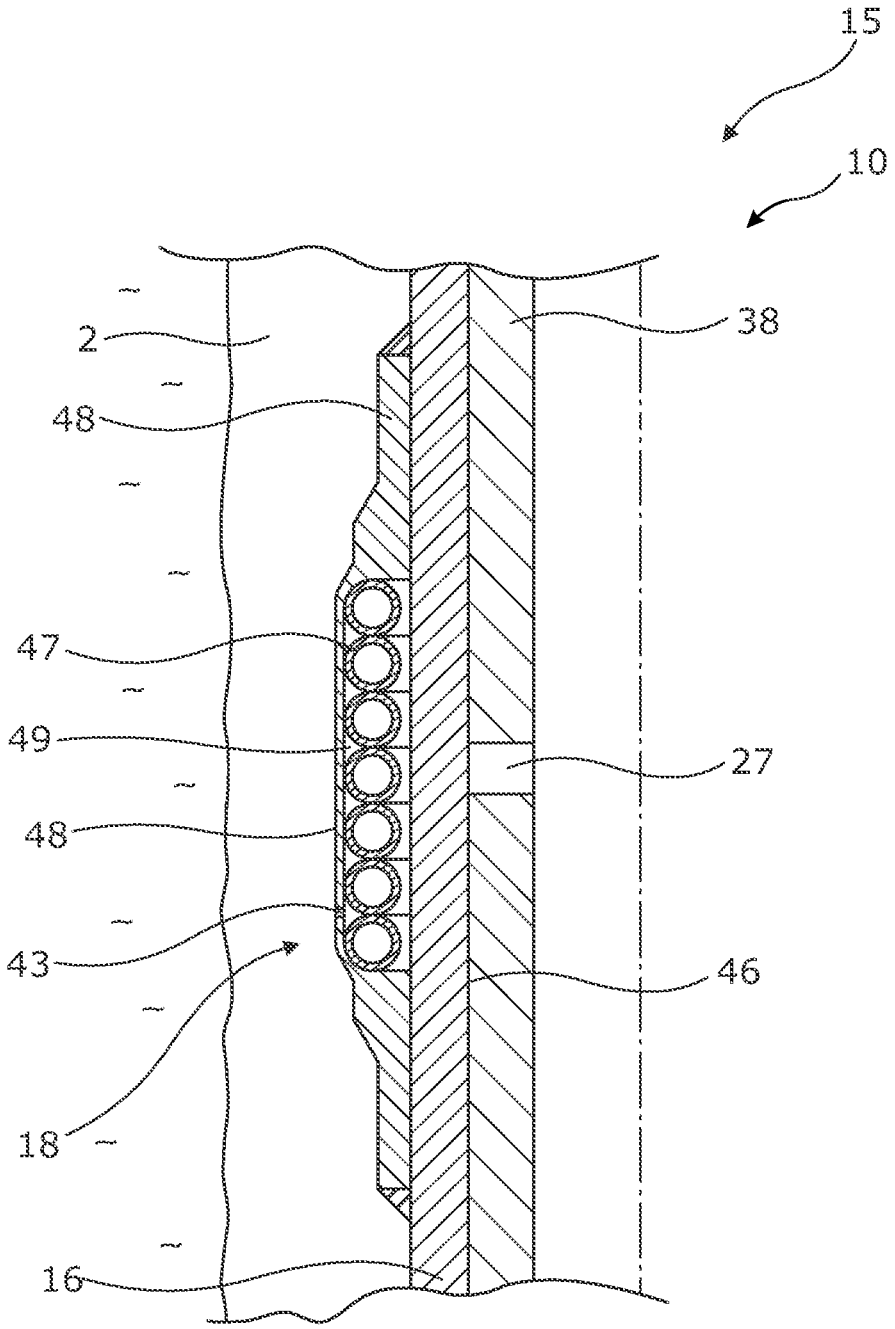
Figure 12:
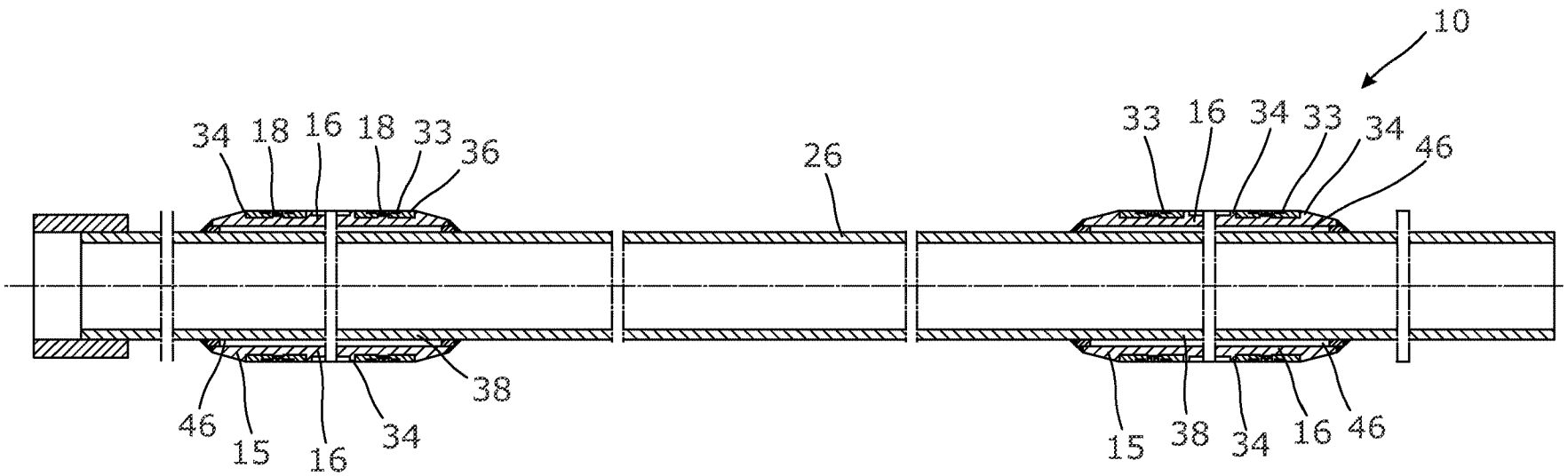

The invention and its many advantages will be described in more detail below with reference to the accompanying schematic drawings, which for the purpose of illustration show some non-limiting embodiments and in which:

FIG. 1 shows a partly cross-sectional view of a downhole straddle system having an un-set straddle assembly, FIG. 2 shows a partly cross-sectional view of the downhole straddle system of FIG. 1 in which the straddle assembly has been set, FIG. 3A shows a partly cross-sectional view of a straddle assembly, FIG. 3B shows a partly cross-sectional view of a downhole tool assembly, FIG. 4A shows a partly cross-sectional view of another straddle assembly, FIG. 4B shows a partly cross-sectional view of another downhole tool assembly, FIG. 5A shows a cross-sectional view of a hydraulic operated deployment tool being in engagement with the straddle assembly, FIG. 5B shows a cross-sectional view of the hydraulic operated deployment tool of FIG. 5A in which the hydraulic pressure has activated the tool so that the tool is free to move away from the straddle assembly, FIG. 5C shows a cross-sectional view of the hydraulic operated deployment tool of FIG. 5A in which the tool is disengaged from the straddle assembly, FIG. 6 shows a partly cross-sectional view of another downhole tool assembly, FIGS. 7A and 7B show a cross-sectional view of other hydraulic expandable annular barriers, FIG. 8 shows a cross-sectional view of another hydraulic expandable annular barrier, FIG. 9 shows a cross-sectional view of another straddle assembly in an expanded and set condition, FIG. 10 shows a partly cross-sectional view of another hydraulic expandable annular barrier having a sealing element with backup, FIG. 11 shows a partly cross-sectional view of another hydraulic expandable annular barrier having a sealing element capable of withstanding high temperatures and having an annular space between the tubular metal part and the expandable metal sleeve, and FIG. 12 shows a cross-sectional view of another straddle assembly in an unexpanded and set condition.

All the figures are highly schematic and not necessarily to scale, and they show only those parts which are necessary in order to elucidate the invention, other parts being omitted or merely suggested.

FIG. 1 shows a downhole straddle system 100 for sealing off a damaged zone 7 in a well tubular metal structure 1 in a well 2. The well tubular metal structure extends from a top 3 of the well or is hung off from another well tubular metal structure closer to the top. The downhole straddle system 100 comprises a straddle assembly 10 having a first end 11, a second end 12 closest to the top, an inner face 14, a first hydraulic expandable annular barrier 15, 15A and a second hydraulic expandable annular barrier 15, 15B. The hydraulic expandable annular barriers are arranged and expanded on each side of the damaged zone 7 in order to seal against the inner face 4 of the well tubular metal structure, and by straddling over the zone by the tubular part 72 between the hydraulic expandable annular barriers, the damaged zone is sealed off. The downhole straddle system 100 further comprises a downhole tool assembly 20 for setting the straddle assembly opposite and sealing off the damaged zone. The downhole tool assembly 20 has a hydraulic operated deployment tool 21 for releasable connecting the downhole tool assembly to the second end of the straddle assembly. The downhole tool assembly further comprises a first sealing unit 22 for sealing against the inner face 14 of the straddle assembly 10. The first sealing unit 22 is arranged above both the first hydraulic expandable annular barrier and the second hydraulic expandable annular barrier. The downhole straddle system 100 further comprises a closing unit 30 configured to close the first end of the straddle assembly and together with the first sealing unit 22 isolate an annular space 73 between the tool assembly 20 and the straddle assembly in order to expand the annular barriers. The downhole tool assembly 20 further comprising a sealing device 23 arranged above the deployment tool 21 and the first sealing unit. The sealing device 23 has an annular sealing element 24 having a first outer diameter OD1 in a first condition, as shown in FIG. 1, and a second outer diameter OD2 in a second condition, as shown in FIG. 2. The second outer diameter OD2 is larger than the first outer diameter for sealing against an inner face 4 of the well tubular metal structure above the straddle assembly towards the top in the second condition. The sealing device 23 comprises a fluid channel 25 configured to fluidly connect an inside 17 of the straddle assembly via the tool assembly with the well tubular metal structure above the sealing device when the sealing device 23 is in the second condition for expanding the first hydraulic expandable annular barrier and the second hydraulic expandable annular barrier.

The sealing device comprises the fluid channel 25 which extends from an outer face 32 of the sealing device to an inside 17 of the straddle assembly.

The sealing device has a first end 31 closest to the top and a second end 35 closest to the straddle assembly, the fluid channel extending from the first end to the inside 17 of the straddle assembly.

The downhole tool assembly 20 is lowered and operated via a wireline 5 and the sealing device is electrically operated through the wireline 5, such as an electric line. The sealing device is set electrically through a wireline/e-line. The sealing device of FIG. 1 is also electrically released but another sealing device may be retrieved by a pulling tool or similar tool pulling or pushing in the top of the downhole tool assembly 20.

In prior art operations, straddles are set by means of coiled tubing or drill pipe which takes longer time to perform, and thus the wireline operated downhole tool assembly makes it possible to arrange and set the straddle at a significantly shorter time saving cost, and the production can continue after a shorter repairing time than with known systems.

The downhole tool assembly 20 is lowered via the wireline 5, such as a slickline, and the sealing device is electrically operated through a battery in the tool assembly. The sealing device 23 is set electrically and activated e.g. by a timer or a pull in the slickline. The sealing device is also electrically released but another sealing device may be retrieved by a pulling tool or a similar tool pulling or pushing in the top of the downhole tool assembly 20.

The first hydraulic expandable annular barrier 15, 15A and the second hydraulic expandable annular barrier 15, 15B may be any kind of packer. In FIGS. 1 and 2, the first hydraulic expandable annular barrier and the second hydraulic expandable annular barrier each comprises an expandable metal sleeve 16. The expandable metal sleeves each have an outer sleeve face 37 configured to abut the inner face 4 of the well tubular metals structure, and the outer sleeve faces comprise at least one seal 18 for enhancing the sealing ability of the annular barriers with the inner face 4 of the well tubular metal structure.

In FIG. 3A, the closing unit is a plug 30A, such as a glass plug or similar disappearing plug, arranged in the first end 11 of the straddle assembly. In FIG. 4A, the closing unit is a rupture disc 30C arranged in the first end 11 of the straddle assembly, and in FIG. 6, the closing unit is a shear ball seat 30B arranged in the first end of the straddle assembly. The shear ball seat is a movable ball seat 63 which is movable from a first position to a second position when a shear pin 64 is sheared, opening for fluid communication between the inside of the tool assembly and the well tubular metal structure through a tool opening 66.

In FIGS. 1 and 2, the downhole tool assembly comprises the closing unit. The downhole tool assembly comprises a tubular section 26 extending below the first sealing unit 22. The closing unit comprises a closed end 30D of the tubular section and a second sealing unit 22B arranged below the first hydraulic expandable annular barrier and the second hydraulic expandable annular barrier. In this way, the closed end 30D of the tubular section and a second sealing unit 22B isolate an annular space 73 between the tool assembly 20 and the straddle assembly in order to expand the annular barriers. The tubular section has at least one opening 27 between the first hydraulic expandable annular barrier and the second hydraulic expandable annular barrier in order to pressurise the annular space 73 and thus the annular barriers.

The straddle assembly 10 may also comprise at least one centraliser 44, as shown in FIG. 1, for centralising the straddle assembly and thus the annular barriers before being expanded. The centralisers 44 also protect the seals 18 of the annular barriers while submerging the straddle assembly and the tool assembly down the well tubular metal structure. The inner face of the straddle assembly 10 may comprise a polished section 45 for abutment against the sealing unit for enhancing the seal therebetween.

In FIGS. 3A and 4A, the first end 11 of the straddle assembly is closed either by a plug or a shear disc. In order to expand the annular barriers of the straddle assembly of FIGS. 3A and 4A, the downhole tool assembly 20 as shown in FIGS. 3B and 4B comprises the hydraulic operated deployment tool 21, the first sealing unit 22 and the sealing device 23, and the tool assembly can be shorter and less complex than compared to the tool assembly of FIGS. 1 and 2 where the tool assembly also needs to provide the closing unit.

In FIGS. 5A and 5B, the deployment tool 21 comprises a tubular base part 51 and a surrounding tubular piston 52. The tubular base part and the tubular piston define an expandable space 53, and the tubular base part has an opening 54 providing fluid communication between an inside 55 of the tubular base part and the expandable space. The tubular piston is connected with retractable engagement elements 56, and the tubular base part comprises at least one indentation 57 for receiving the retractable engagement elements. The inner face of the straddle assembly comprises at the second end a groove 58 for engagement with the engagement elements. The engagement elements have a projection 59 for engagement with the groove of the straddle assembly. The deployment tool comprises a shear unit/breakable element 61 connecting the tubular base part and the tubular piston so that when shearing the shear unit, the tubular piston is allowed to move in relation to the tubular base part. The deployment tool comprises a spring 62 circumferenting the tubular base part.

The deployment tool 21 comprises a fail-safe arrangement 41 configured to maintain the engagement elements in engagement with the straddle assembly in a first position and at a predetermined pressure move to a second position in which the engagement elements are allowed to retract from engagement with the straddle assembly. The fail-safe arrangement comprises a breakable element 61 which at the predetermined pressure breaks, allowing the engagement elements to move out of engagement with the straddle assembly. The fail-safe arrangement further comprises the tubular piston 52 movable from the first position to the second position of the deployment tool when influenced by a pressure above a certain/predetermined pressure in order to break the breakable element 61.

In FIG. 6, the deployment tool 21 is configured to release above a certain pressure or by a fluid flow. By fluid flow is meant a certain flow through the hydraulic operated deployment tool 21 which activates the release of the deployment tool engagement with the straddle assembly.

The sealing device 23 of FIG. 6 comprises an electric motor 28 for operating the sealing element 24 between the first outer diameter and the second outer diameter. The electric motor may be powered by a battery or through the wireline 5, such as an electric line.

The invention further relates to a downhole well system 200 comprising the well tubular metal structure 1 and the downhole straddle system 100 configured to be arranged opposite the damaged zone 7 for arranging the straddle assembly 10 over the damaged zone. The downhole well system 200 further comprises a pump 50 arranged at the top of the well tubular metal structure configured to pressurise the well tubular metal structure above the sealing device 23, when the sealing device is in its second condition.

The well tubular metal structure is thus repaired by detecting a damaged zone 7 of the well tubular metal structure 1, arranging a downhole straddle system 100 opposite the damaged zone, activating the annular sealing element 24 of the sealing device 23, then pressurising the well tubular metal structure above the sealing device, and thereby expanding the first hydraulic expandable annular barrier and the second hydraulic expandable annular barrier via the fluid channel 25 of the sealing device for isolating the damaged zone. Subsequently, the annular sealing element of the sealing device is deactivated, the deployment tool is released from the straddle assembly, and the downhole tool assembly is then removed from the well tubular metal structure. The well tubular metal structure may be pressurised above a certain pressure whereby the deployment tool is released from the straddle assembly. The pressure either generates a flow through activating the release or directly moves the piston for releasing the straddle assembly.

In order to release the sealing device, a stroking or pulling tool may pull or push in the top of the tool assembly in order to release the tool. A stroking tool is a tool providing an axial force. The stroking tool comprises an electrical motor for driving a pump. The pump pumps fluid into a piston housing to move a piston acting therein. The piston is arranged on the stroker shaft. The pump may pump fluid into the piston housing on one side and simultaneously suck fluid out on the other side of the piston.

In FIG. 7A, the hydraulic expandable annular barrier 15 has end connections and two such hydraulic expandable annular barriers may be connected to a tubular section and form the straddle assembly. FIG. 7B discloses another hydraulic expandable annular barrier without any base pipe or any tubular metal part underneath the expandable metal sleeve 16. In both FIGS. 7A and 7B, the seals 18 are arranged in grooves 39 (shown in FIG. 10) of the expandable metal sleeve 16.

In FIG. 8, the hydraulic expandable annular barrier 15 has an expandable metal sleeve 16 and two end connections, and two such hydraulic expandable annular barriers 15 may be connected to a tubular section and form the straddle assembly. The seals 18 are arranged between projections 34 of the expandable metal sleeve 16, as is also shown in FIG. 10, and the seals 18 have back-up rings 33, such as helically or coiled metal key rings. As shown in FIG. 8, an intermediate element 36 is arranged between the seals 18 and the back-up rings 33.

The straddle assembly 10 may have three or more hydraulic expandable annular barriers 15, as shown in FIG. 9, and two tubular sections 26 arranged therebetween.

By fluid or well fluid is meant any kind of fluid that may be present in oil or gas wells downhole, such as natural gas, oil, oil mud, crude oil, water, etc. By gas is meant any kind of gas composition present in a well, completion, or open hole, and by oil is meant any kind of oil composition, such as crude oil, an oil-containing fluid, etc. Gas, oil, and water fluids may thus all comprise other elements or substances than gas, oil, and/or water, respectively.

An annular barrier 15 may be an annular barrier comprising a tubular metal part 38 mounted to the tubular section of the straddle assembly 10, and the annular barrier may comprise an expandable metal sleeve 16 connected to and surrounding the tubular metal part defining an annular barrier space 46, as shown in FIGS. 11 and 12. The tubular metal part may have an opening 27, and the expandable metal sleeve 16 is expanded by letting fluid into the annular barrier space through the opening. The seal 18, as shown in FIG. 11, is a sealing element capable of withstanding high temperatures since the seal 18 comprises a metal sealing sleeve 48 connected to the expandable metal sleeve 16 forming an annular space 49 in which at least one metal spring 47 is arranged. The metal sealing sleeve 48 has an opening 43.

In FIG. 12, the straddle assembly 10 comprises two hydraulic expandable annular barriers 15. Each hydraulic expandable annular barrier has tubular metal part 38 mounted to the tubular section 26 of the straddle assembly 10 and a surrounding expandable metal sleeve 16 defining an annular barrier space 46. The tubular metal part has at least one opening opposite each annular barrier, and the expandable metal sleeve 16 is expanded by letting fluid into the annular barrier space through the opening. Seals 18 are arranged between projections 34 of the expandable metal sleeve 16, and the seals 18 have back-up rings 33, such as helically or coiled metal key rings. An intermediate element 36 is arranged abutting the seals 18 and partly underneath the back-up ring 33. The main part of the intermediate element 36 is arranged abutting the projection 34.

As shown in FIG. 1, the first end 11 of the straddle assembly 10 may comprise a mule shoe so as to easier direct an intervention tool into the straddle assembly when being pulled out of the well at a later intervention assignment.

By a casing or well tubular metal structure is meant any kind of pipe, tubing, tubular, liner, string etc. used downhole in relation to oil or natural gas production.

In the event that the tool is not submergible all the way into the casing, a downhole tractor can be used to push the tool all the way into position in the well. The downhole tractor may have projectable arms having wheels, wherein the wheels contact the inner surface of the casing for propelling the tractor and the tool forward in the casing. A downhole tractor is any kind of driving tool capable of pushing or pulling tools in a well downhole, such as a Well Tractor®.

Although the invention has been described in the above in connection with preferred embodiments of the invention, it will be evident for a person skilled in the art that several modifications are conceivable without departing from the invention as defined by the following claims.

The invention claimed is:

1. A downhole straddle system for sealing off a damaged zone in a well tubular metal structure in a well having a top, comprising:

a straddle assembly having a first end, a second end closest to the top, an inner face, a first hydraulic expandable annular barrier and a second hydraulic expandable annular barrier, a downhole tool assembly having a hydraulic operated deployment tool for releasable connecting the downhole tool assembly to the second end of the straddle assembly, the downhole tool assembly further comprising a first sealing unit arranged above the first hydraulic expandable annular barrier and the second hydraulic expandable annular barrier and configured to seal against the inner face of the straddle assembly, and a closing unit configured to close the first end of the straddle assembly, wherein the downhole tool assembly further comprising a sealing device arranged above the deployment tool and the first sealing unit, the sealing device has an annular sealing element having a first outer diameter in a first condition and a second outer diameter being larger than the first outer diameter in a second condition for sealing against an inner face of the well tubular metal structure, the sealing device comprises a fluid channel to fluidly connect an inside of the straddle assembly with the well tubular metal structure above the sealing device when the sealing device is in the second condition for expanding the first hydraulic expandable annular barrier and the second hydraulic expandable annular barrier.

2. A downhole straddle system according to claim 1, wherein the sealing device is electrically operated through a wireline, such as an electric line.

3. A downhole straddle system according to claim 1, wherein the closing unit is a plug, a shear ball seat or a rupture disc arranged in the first end of the straddle assembly.

4. A downhole straddle system according to claim 1, wherein the downhole tool assembly comprises the closing unit, the downhole tool assembly comprises a tubular section extending below the first sealing unit, the closing unit comprises a closed end of the tubular section and a second sealing unit arranged below the first hydraulic expandable annular barrier and the second hydraulic expandable annular barrier.

5. A downhole straddle system according to claim 4, wherein the tubular section has at least one opening between the first hydraulic expandable annular barrier and the second hydraulic expandable annular barrier.

6. A downhole straddle system according to claim 1, wherein the sealing device comprises an electric motor for operating the sealing element between the first outer diameter and the second outer diameter.

7. A downhole straddle system according to claim 1, wherein the deployment tool comprises engagement elements for engaging the inner face of the straddle assembly at the second end.

8. A downhole straddle system according to claim 1, wherein the first hydraulic expandable annular barrier and the second hydraulic expandable annular barrier each comprises an expandable metal sleeve.

9. A downhole straddle system according to claim 7, wherein the deployment tool comprises a fail-safe arrangement configured to maintain the engagement elements in engagement with the straddle assembly in a first position and at a predetermined pressure move to a second position in which the engagement elements are allowed to retract from engagement with the straddle assembly.

10. A downhole straddle system according to claim 9, wherein the fail-safe arrangement comprises a breakable element.

11. A downhole straddle system according to claim 9 or 10, wherein the fail-safe arrangement comprises a tubular piston movable from the first position to the second position of the deployment tool when influenced by a pressure above a certain pressure.

12. A downhole well system comprising:

a well tubular metal structure having a top and a damaged zone, a downhole straddle system according to claim 1 configured to be arranged opposite the damaged zone for arranging a straddle assembly over the damaged zone, and a pump arranged at the top of the well tubular metal structure configured to pressurise the well tubular metal structure.

13. A repairing method, comprising:

detecting a damaged zone of a well tubular metal structure, arranging a downhole straddle system according to claim 1 opposite the damaged zone, activating the annular sealing element of the sealing device, pressurising the well tubular metal structure above the sealing device, expanding the first hydraulic expandable annular barrier and the second hydraulic expandable annular barrier via the fluid channel of the sealing device for isolating the damaged zone, deactivating the annular sealing element of the sealing device, releasing the deployment tool from the straddle assembly, and removing the downhole tool assembly from the well tubular metal structure.

14. A repairing method according to claim 13, whereby the sealing device is electrically operated through a wireline, such as an electric line.

15. A repairing method according to claim 13, whereby the well tubular metal structure is pressurised above a certain pressure whereby the deployment tool is released from the straddle assembly.

* * * * *